United States Patent [19]

Hachisuka

[11] 4,300,951

[45] Nov. 17, 1981

[54] LIQUID PHASE SINTERED DENSE COMPOSITE BODIES AND METHOD FOR PRODUCING THE SAME

[75] Inventor: Takeji Hachisuka, Toyama, Japan

[73] Assignee: Kabushiki Kaisha Fujikoshi, Toyama, Japan

[21] Appl. No.: 11,669

[22] Filed: Feb. 12, 1979

[30] Foreign Application Priority Data

Feb. 24, 1978 [JP] Japan ..... 53/19610

[51] Int. Cl.[3] ..... C22C 29/00; B22F 7/00

[52] U.S. Cl. ..... 75/236; 75/208 R; 75/200; 75/243; 75/241; 75/203; 428/564; 428/549

[58] Field of Search ..... 428/564, 556, 545, 539.5, 428/549, 562, 563, 565; 75/236, 208 R, 208 C, 200, 244, 232, 241, 243, 246, 201-206

[56] References Cited

U.S. PATENT DOCUMENTS

| | | | |
|---|---|---|---|
| 2,455,804 | 12/1948 | Ransley et al. | 75/208 R |
| 2,506,556 | 5/1950 | Ball et al. | 428/565 |
| 2,906,007 | 9/1959 | Bibbins | 75/DIG. 1 |
| 3,068,016 | 12/1962 | Dega | 75/244 X |
| 3,071,526 | 1/1963 | Litt | 75/208 R X |
| 3,114,197 | 12/1963 | DuBois et al. | 75/DIG. 1 |
| 3,218,135 | 11/1965 | Alexander et al. | 428/565 |
| 3,233,985 | 2/1966 | Kraft et al. | 75/DIG. 1 |
| 3,310,387 | 3/1967 | Sump et al. | 75/DIG. 1 |
| 3,323,915 | 6/1967 | Lambert et al. | 75/208 R X |
| 3,409,473 | 11/1968 | Weber et al. | 75/208 R |
| 3,427,185 | 2/1969 | Cheatham et al. | 428/539.5 X |
| 3,460,920 | 8/1969 | Long et al. | 428/539.5 |
| 3,672,849 | 6/1972 | Bredzs et al. | 75/244 X |
| 3,684,497 | 8/1972 | Wendler et al. | 428/565 X |
| 3,725,016 | 4/1973 | Mal et al. | 428/545 |
| 3,779,716 | 12/1973 | Riley et al. | 75/DIG. 1 |
| 3,790,353 | 2/1974 | Jackson et al. | 75/208 X |
| 3,844,019 | 10/1974 | Schwayder et al. | 428/545 X |
| 3,889,348 | 6/1975 | Lamelson | 428/539.5 X |
| 4,113,920 | 9/1978 | Helton et al. | 428/565 |

FOREIGN PATENT DOCUMENTS

| | | | |
|---|---|---|---|
| 2049416 | 4/1972 | Fed. Rep. of Germany | 75/208 R |
| 2851141 | 2/1979 | Fed. Rep. of Germany | 75/208 R |

OTHER PUBLICATIONS

Metcalfe, A. G., *Fiber Metallurgy* in "Metal Progress", Mar. 1955, pp. 81-84.

*Primary Examiner*—Brooks H. Hunt
*Attorney, Agent, or Firm*—Spencer & Kaye

[57] ABSTRACT

A liquid phase sintered dense composite body comprising a hard refractory metal carbide which is densely cemented by sintering with a metal or alloy components. The sintered composite body incorporates at a surface or in the interior a multiplicity of metallic elements consisting of coarse grains, strands and/or plates of either the same metal or alloy as the cementing component or metallic elements having a melting point at least 120° C. higher than the temperature at which the liquid phase takes place on sintering. This liquid phase sintered dense composite body is manufactured by placing the coarse grains, strands and/or plates on the surface or within the compacted powder mixture prior to the liquid phase sintering operation.

17 Claims, 2 Drawing Figures x150 x15

LIQUID PHASE SINTERED DENSE COMPOSITE BODIES AND METHOD FOR PRODUCING THE SAME

BACKGROUND OF THE INVENTION

This invention relates to liquid phase sintered dense composite bodies typified by hard metals and cermets obtained by cementing hard refractory material, such as carbides, nitrides, oxides, borides, silicides, etc., with a metal and to methods for producing the same. More particularly, it relates to dense liquid phase sintered composite bodies containing a cementing metal component in very large amounts in limited sections or throughout the entirety of the composite and to a method for producing the same.

In producing a liquid phase sintered composite body, a cementing metal in the form of a fine powder having a grain size of from less than 1 μm to several μm is used, in order to facilitate the densification of the composite in the sintering process and to impart optimum properties to the sintered composite. Hard refractory material and cementing metal in powder form are uniformly mixed and compacted to produce a compact body which is subsequently sintered by heating to a sintering temperature and holding the compact body at the sintering temperature. In the liquid phase sintering process, the cementing metal component is melted and the compact body rapidly contracts due to the surface tension of the molten cementing metal component, thereby densifying the entire sintered body. The transformation of the cementing metal component into a liquid phase will be described in more detail. In the process of heating the compact body to a sintering temperature and holding it at such temperature, the elements of the hard refractory material in contact with the cementing metal diffuse in solid state into the cementing metal. This change in the composition of the cementing metal caused by the solid-state diffusion of the elements results in lowering of the melting point of the cementing metal component. It is well known that if the cementing metal forms a eutectic alloy with the elements diffused thereinto, then the cementing metal component is melted and densification of the compact body occurs upon heating the compact body to a temperature higher than the eutectic point. For example, in a liquid phase sintered composite of the WC—Co system, the melting point of cobalt metal is 1495° C. However, since the cementing metal component of this composite has a eutectic point of about 1280° C., sintering is liable to take place in a temperature range of 1350° to 1450° C. which is in a range between the melting point of the cobalt metal and the eutectic point of the cementing component. In a liquid phase sintered composite of the TiC—Ni—Mo system, the eutectic point of the cementing metal component is about 1270° C., so that the sintering of the composite usually takes place at a temperature less than 1450° C. which is the melting point of nickel metal.

As aforesaid, when these sintered bodies are produced, the sintering temperatures are below the melting points of the cementing metals in many cases. The time required for the cementing metal component to melt and change into a liquid phase while being heated and held at a sintering temperature is governed by the composition change of the cementing metal due to the solid phase diffusion of the elements constituting the hard refractory material. Thus, the time may vary depending on the manner in which the raw materials in powder form are mixed with each other, the manner in which powder bodies of the raw materials are in contact with each other and the grain size of the cementing metal powder.

On the other hand, in producing a liquid phase sintered composite body by sintering, it would be difficult to keep a compact body of a mixture of hard refractory material and a cementing metal in its original shape if the amount of the cementing metal contained therein were very large, because the cementing metal component of the compact body is melted in the process of sintering, thereby making it impossible to produce a sintered body of the desired shape. Thus, restrictions are placed on the amount of the cementing metal contained in the compact body.

SUMMARY OF THE INVENTION

This invention has as an object the provision of a liquid phase sintered dense composite formed of hard refractory material, such as carbides, nitrides, oxides borides, silicides, etc., cemented with a metal or alloy in such a manner that coarse grains, strands or plates made of the same or a similar metal or alloy as the cementing metal component are contained in large amounts either in limited sections or throughout the entire body of the composite.

Another object of the present invention is to provide a method for producing such dense liquid phase sintered composites.

The present invention is based on the phenomenon that the elements of the hard refractory material in a liquid phase sintered composite diffuse in the solid state into the cementing metal component of the composite and thus results in a reduction in the melting point of the cementing metal component, and that the time required for the transformation of the cementing metal into a liquid phase to occur may vary depending on the grain size of the cementing metal component.

According to the invention, metallic elements in the form of coarse grains, strands or plates of the same metal as the cementing metal having a diameter or thickness larger than the grain size of the cementing metal powder are brought into contact with, or placed in a compact body of a mixture of the raw materials in powder form when such compact body is formed by compacting. The compact body thus formed is heated to a temperature range below the melting point of the cementing metal powder and above the eutectic point of the cementing metal component, to effect sintering thereof. At stages wherein the cementing metal component is melted and densification of the compact body rapidly takes place, the diffusion of the elements of the hard refractory material in the solid state does not take place sufficiently to convert the composition of the metal forming the interior portions of the coarse grains, strands or plates to permit the transformation of the metal into a liquid state to occur at the prevailing temperature. Thus the interior portions of the coarse grains, strands or plates are still in the solid state. The present invention is based on the discovery that if the melting point of the cementing metal component forming the coarse grains, strands or plates, having a diameter or thickness over twenty times as large as the grain size of the cementing metal powder in the compact body is at least 120° C. higher than the melting point of the cementing metal component of the mixture of raw materials in powder form, it is possible to effect densification of the sintered compact body while keeping the coarse grains, strands or plates in the compact body in the solid state. This is accomplished by adjusting the diameter or thickness of the coarse grains, strands or plates and the sintering conditions including the rate at which the temperature is increased.

The liquid phase sintered composite body according to the present invention is dense and contains large amounts of a metal component which is the same as or similar to the cementing metal in limited sections or throughout the entire body of the composite, and has a unique microstructure and properties which differ from those of the liquid phase sintered composites of the prior art.

DESCRIPTION OF THE EMBODIMENTS

Embodiments of the invention will now be described by referring to the following examples.

EXAMPLE 1

A mesh of 100 mesh sieve size formed of pure nickel strands 100μ in diameter was cut into a square with a side of 12 mm, heated at 900° C. for one hour in a hydrogen atmosphere, and then gradually cooled to effect annealing. A mixture of powder of the composition containing, in weight percent, 70% TiC-20% Ni-10% Mo prepared by the usual method was charged in a small amount in a square metal mold with a side of 15 mm, the aforesaid square mesh of nickel placed on the charge, and a predetermined amount of the mixture of powder charged in the metal mold. The charge was pressed under a pressure of 2 ton/cm$^2$ to produce a compact body 5 mm in thickness. The compact body of powder mixture was subjected to pre-sintering at a temperature of 600° C. for one hour, the pre-sintered body sintered by increasing the temperature at a rate of 12° C./min from 600° C. to a predetermined temperature and holding the pre-sintered body being held at a predetermined temperature within the range 1280° to 1350° C. for 1 hour in a vacuum.

Figure 1:
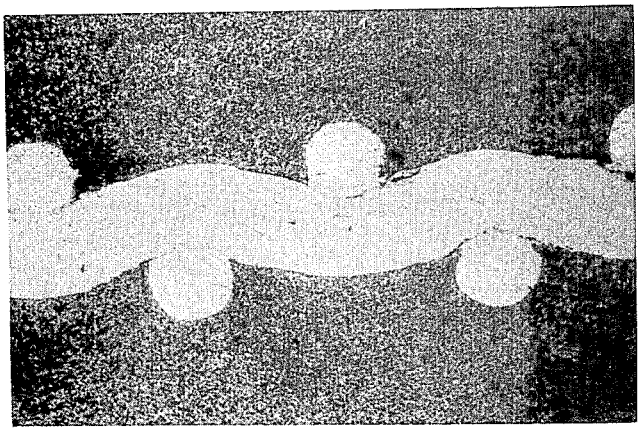
FIG. 1 is a microphotograph (×150) obtained with an optical microscope of the liquid phase sintered composite according to the invention sintered at 1320° C. as described in Example 1, showing the nickel metal disposed in a mesh-like structure in the composite and the microstructure in the vicinity of the mesh-like nickel structure.

The character of the sintered body and the condition of the mesh-like structure of nickel are as shown in Table 1. FIG. 1 shows the condition of the mesh-like structure in the sintered body obtained by sintering at 1320° C. and the microstructure of the portions of the sintered body in the vicinity of the mesh-like structure of nickel. When sintered at 1300° to 1330° C., the sintered body had a dense, normal microstructure and the nickel in mesh-like structure placed in the compact body of raw materials in powder form retained its substantially original shape in the sintered body. Thus, it has been ascertained that the method according to the present invention is capable of producing a dense liquid phase sintered composite body containing markedly large amounts of the cementing metal component in limited sections of the composite which has hitherto been impossible to produce by the powder metallurgy methods of the prior art.

TABLE 1

| Sintering Temperature | Condition of Mesh-like Structure of Nickel | Microstructure of Sintered Body |
|---|---|---|
| 1280° C. | Not melted, and original shape is retained. | Densification is not satisfactory. |
| 1300° C. | Not melted, and original shape is retained. | Substantially densified, is normal structure. |
| 1320° C. | Not melted, and original shape is retained. | Densified, normal structure. |
| 1330° C. | Not melted, and original shape is retained. | Densified, normal structure. |
| 1350° C. | Melted and open cavities are formed in portions where mesh-like structure existed. | Densified, normal structure. |

EXAMPLE 2

Figure 2:
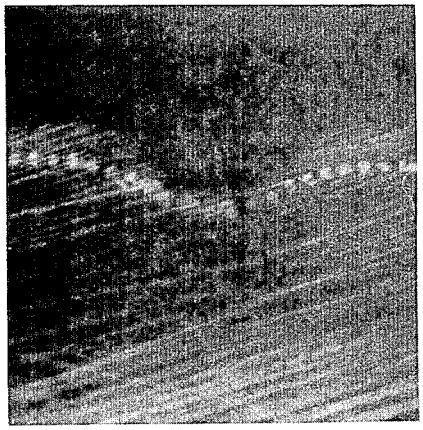
FIG. 2 is a microphotograph (×15) obtained with an optical microscope of the liquid phase sintered composite according to the invention having a wave-like nickel mesh structure as described in Example 2, showing the nickel mesh structure and the portions of the sintered body in the vicinity of the nickel mesh structure.

The lower member of a metallic mold of a rectangular shape, 12 mm×42 mm, was formed with five projections of a semi-circular shape with a radius of 1 mm equidistantly spaced apart from one another and located normal to the longitudinal axis of the mold. Predetermined varying amounts of a mixture of powder of the composition containing, in weight percent, 75% TiC-15% Ni-10% Mo prepared by the usual method were first charged in the aforesaid metal mold, a mesh of nickel similar to that described in Example 1 but having a size of 10 mm×40 mm was placed on the charge in the metal mold, and then a predetermined amount of the mixture of powder was charged into the metal mold. The charge compacted under a pressure of 2 ton/cm$^2$ to produce a compact body 5 mm in thickness. After subjecting the compact body of powder mixture to pre-sintering at 900° C. for one hour, the pre-sintered body was sintered by increasing the temperature at a rate of 10° C./min and holding the pre-sintered body at 1330° C. for one hour in a vacuum. The sintered bodies thus obtained had the mesh-like structure of nickel present in wave form along the semi-circular projections of the lower mold member. It was ascertained that the sintered bodies had been completely densified and the mesh-like structure of nickel had retained substantially its original shape without melting. FIG. 2 shows the condition of the mesh-like structure of nickel after being sintered. Table 2 shows the relation between the depth of the mesh-like structure of nickel in the compact body and the deflection of the sintered body in the sintered composites produced. It has been ascertained that if the mesh-like structure of nickel wire is present within a depth of 0.4 mm, the mesh-like structure of nickel will be readily deformed in the longitudinal direction as the compact body contracts and the sintered body produced will be substantially free from deflection;

TABLE 2

| Position of Mesh-like Structure of Nickel (Depth from the Surface m/m) | Bowing of the Sintered Body (m/m) |
|---|---|
| 0.2 | 0.07 |
| 0.3 | 0.10 |
| 0.35 | 0.11 |
| 0.4 | 0.12 |
| 0.5 | 0.27 |
| 0.8 | 0.38 |

The sintered bodies produced in this way were joined by brazing, at the surface thereof on which the mesh-like structure of nickel was present, to a steel material of 8 mm in thickness by using a brazing alloy containing silver, and were ground under various conditions. Sintered bodies of similar shape having no mesh-like structure of nickel were also joined by brazing to a steel material of the same thickness, and were ground under the same conditions as the sintered bodies according to the invention to investigate the development of cracks due to grinding. It has been found that the development of cracks is encountered less often in sintered bodies with the mesh-like structure of nickel due apparently to the fact that stress generated by brazing is mainly absorbed by the mesh-like structure of nickel, as compared with sintered bodies that do not have the mesh-like structure of nickel, so that the sintered bodies according to the invention displayed excellent properties as sintered bodies for brazing.

EXAMPLE 3

To a mixture of powder of the composition containing, in weight percent, 94% WC-6% Co prepared by the usual method were added coarse grains of cobalt of a grain size of 60 to 100 mesh by 10 weight percent with respect to the mixture of powder. The mixture was thoroughly mixed manually by using a mortar and charged into a square metal mold with a side of 15 mm. The charge was compacted under a pressure of 2 ton/cm$^2$ to produce a compact body of 5 mm in thickness. After subjecting the compact body of powder mixture at 600° C. for one hour, the pre-sintered body was sintered by increasing the temperature at a rate of 15° C./min from 600° to 1350° C. and holding the pre-sintered body for one and half hours in vacuum. The sintered body thus obtained was completely densified and had a special structure in which the coarse grains of cobalt were scattered in substantially their original shape in a normal structure of the tungsten carbide phase and the cobalt cementing phase was distributed evenly in fine particles. Liquid phase sintered composites having such a structure have not hitherto been produced by methods of the prior art.

EXAMPLE 4

To the powder mixture of 70% TiC-20% Ni-10% Mo used in Example 1 were added coarse grains of 410L type stainless steel (melting point, 1482° to 1532° C.) having a grain size of 60 to 100 mesh in 20 weight percent with respect to the powder mixture, and the mixture thoroughly mixed manually by using a mortar. The mixture was charged into a square metal mold with a side of 15 mm, and the charge compacted under a pressure of 2 ton/cm$^2$ to produce a compact body 3 mm in thickness. After subjecting the compact body of powder mixture to pre-sintering at a temperature of 600° C. for one hour, the pre-sintered body was charged into a vacuum furnace. After heating the heating zone of the vacuum furnace to 1340° C. beforehand, the pre-sintered compact body was held at that temperature for one hour in the heating zone of the vacuum furnace to effect sintering. The sintered body produced in this way was completely densified, and the coarse grains of type 410L stainless steel found to remain in their substantially original shapes.

While various embodiments of the invention have been shown and described hereinabove, it is to be understood that the coarse grains, strands or plates used in the present invention need not necessarily be of the same metal as the composition of the cementing metal. Any metal or alloy may be used for forming the coarse grains, strands or plates so long as such metal or alloy has a melting point over 120° C. higher than the temperature at which the transformation of the cementing metal component into the liquid phase takes place in the sintering process, good wettability with respect to the hard refractory material, and is effective as a cementing metal component. The reason why such metal or alloy can be used is that in view of the mechanism described in the summary of the invention, such metal or alloy can apparently achieve the same effects by a phenomenon similar to that observed when the same metal as the cementing metal component is used.

The reason why the diameter or thickness of the coarse grains, strands or plates is restricted to a value over twenty times as large as the grain size of the cementing metal powder is explained as follows:

If the coarse grains, strands or plates had a diameter or thickness smaller than the aforesaid value, it would be practically impossible to densify the sintered body while the grains, strands or plates remain in the solid state, in view of the rate of diffusion of the elements of the hard refractory material after the transformation of cementing metal component into a liquid phase has occurred.

The reason why the melting point of a metal or alloy forming the coarse grains, strands or plates in the present invention should be 120° C. higher than the temperature at which the transformation of the cementing metal component of the sintered body into a liquid phase occurs is as follows. It has been ascertained that if the temperature difference is below 120° C., it is almost impossible, from a technical point of view, to densify the sintered body while keeping the coarse grains in the solid state by adjusting the sintering conditions. An example is the product obtained when coarse grains of a Ni—Cr alloy (melting point, 1380° to 1420° C.) containing 25% chromium or Inconel (melting point, 1370° to 1400° C.) are mixed with a mixture of powder of a composite of the TiC—Ni—Mo system having a eutectic temperature of 1270° C.

I claim:

1. A liquid phase sintered dense composite body, comprising:

a first multiplicity of particles including at least one hard refractory metal carbide selected from the group consisting of TiC and WC;

a second multiplicity of particles including at least one cementing metal having a relatively fine grain size, said cementing metal cementing together said particles of hard refractory metal carbide after having been melted by liquid phase sintering and then solidified; and a multiplicity of metallic elements having the same composition as said cementing metal integrally incorporated with said composite body, said metallic elements having a melting point which is at least 120° C. higher than the eutectic temperature of said refractory and cementing metals, said metallic elements further having a thickness which is at least twenty times the grain size of said cementing metal component.

2. A liquid phase sintered dense composite body as defined in claim 1, wherein said multiplicity of metallic elements consist of at least one of coarse grains, strands and plates.

3. A liquid phase sintered dense composite body as claimed in claim 2, wherein said multiplicity of coarse grains, strands and plates are incorporated on at least one surface of said sintered composite body.

4. A liquid phase sintered dense composite body as claimed in claim 2; wherein said multiplicity of coarse grains, strands and plates are incorporated in the interior of said sintered dense composite body.

5. A liquid phase sintered dense composite body as claimed in claim 1; wherein said multiplicity of coarse grains, strands and plates are distributed throughout said entire composite body.

6. A liquid phase sintered dense composite body as claimed in claim 1 or 2 which consists by weight of 70% TiC, said cementing component consists of 20% Ni and 10% Mo, and said multiplicity of metallic elements comprise a mesh of strands of pure nickel incorporated in the interior of said sintered composite body.

7. A liquid phase sintered dense composite body as claimed in claim 1 or 2 which consists by weight of a refractory metal of 75% TiC, said cementing component consists of 15% Ni and 10% Mo, and said multiplicity of metallic components comprise a mesh of strands of pure nickel incorporated in the interior of said sintered composite body.

8. A liquid phase sintered dense composite body as claimed in claim 1 or 2 which consists by weight of a refractory metal of 94% WC, said cementing component of 6% Co and which further contains 10% by weight of coarse grains of Co incorporated throughout the entirety of said composite body.

9. A liquid phase sintered dense composite body as claimed in claim 1 or 2 which consists by weight of a refractory metal of 70% TiC, said cementing component of 20% Ni and which further contains 10% by weight of coarse grains of type 410L stainless steel incorporated throughout the entirety of said composite body.

10. A method of making a liquid phase sintered dense composite body comprising a first multiplicity of particles including at least one base refractory metal carbide selected from the group consisting of TiC and WC, a second multiplicity of particles including at least one cementing metal component which cements together said first multiplicity of particles after having been melted by liquid phase sintering and then solidified, and a multiplicity of metallic elements having the same composition as said cementing metal component integrally incorporated with said composite body, said method comprising the steps of:

preparing a powder of said hard refractory metal carbide;

preparing a powder of said at least one cementing metal component;

preparing said multiplicity of metallic elements in the form of at least one of coarse grains, strands and plates, said metallic elements having a melting point which is at least 120° C. higher than the eutectic temperature of said refractory and cementing metals and a thickness which is at least twenty times the grain size of said cementing metal component;

mixing said powders of hard refractory metal carbide and cementing metal component to form a powder mixture;

incorporating said multiplicity of metallic elements with said powder mixture at a predetermined position;

compacting said powder mixture and incorporated multiplicity of metallic elements; and heating the thus prepared compacted powder mixture and metallic elements to a temperature in the range 1280° C.–1350° C. to form a eutectic liquid phase at which sintering takes place, said heating being carried out for a sufficient time to cement said hard refractory metal carbide with said eutectic, said incorporated multiplicity of metallic elements being maintained at said predetermined position without being destroyed.

11. A method of making a liquid phase sintered dense composite body as claimed in claim 10 wherein the predetermined position at which said multiplicity of metallic elements are placed for incorporation with said powder mixture is such that after compacting they are on at least one surface of said compacted powder mixture.

12. A method of making a liquid phase sintered dense composite body as claimed in claim 10 wherein the predetermined position at which said multiplicity of metallic elements are placed for incorporation with said powder mixture is such that after compacting they are in the interior of said compacted powder mixture.

13. A method of making a liquid phase sintered dense composite body as claimed in claim 10 wherein said multiplicity of metallic elements are prepared in the form of coarse grains and are incorporated with said powder mixture such that said coarse grains are distributed throughout the entirety of said composite body.

14. A method of making a liquid phase sintered dense composite body as claimed in claim 10 wherein said powder mixture consists by weight of a refractory metal of 70% TiC and a cementing component of 20% Ni and 10% Mo, and wherein said metallic elements comprise a mesh of strands of pure nickel incorporated in the interior of said compacted mixture.

15. A method of making a liquid phase sintered dense composite body as claimed in claim 10 wherein said powder mixture consists by weight of a refractory metal of 75% TiC and a cementing component of 15% Ni and 10% Mo, and wherein said metallic elements comprise a mesh of strands of pure nickel incorporated in the interior of said sintered composite body.

16. A method of making a liquid phase sintered dense composite body as claimed in claim 10 wherein said powder mixture consists by weight of a refractory metal of 94% WC and a cementing component of 6% Co, and wherein 10% by weight of coarse grains of Co are incorporated throughout the entirety of said composite body.

17. A method of making a liquid phase sintered dense composite body as claimed in claim 10 wherein said powder mixture consists by weight of a refractory metal of 70% TiC, a cementing metal component of 20% Ni and a metallic element consisting of 10% type 410L stainless steel incorporated throughout the entirety of said composite body.

* * * * *